US009536724B2

(12) United States Patent
Garside et al.

(10) Patent No.: US 9,536,724 B2
(45) Date of Patent: Jan. 3, 2017

(54) ION GUIDE CONSTRUCTION METHOD

(71) Applicant: Micromass UK Limited, Wilmslow (GB)

(72) Inventors: John Richard Garside, Saddleworth (GB); Martin Raymond Green, Bowdon (GB); Daniel James Kenny, Knutsford (GB); Jeffrey Ellis Lockett, Stockport (GB); Richard Barrington Moulds, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/386,974

(22) PCT Filed: Mar. 15, 2013

(86) PCT No.: PCT/GB2013/050643

§ 371 (c)(1),
(2) Date: Sep. 22, 2014

(87) PCT Pub. No.: WO2013/140139

PCT Pub. Date: Sep. 26, 2013

(65) Prior Publication Data

US 2015/0060655 A1 Mar. 5, 2015

Related U.S. Application Data

(60) Provisional application No. 61/638,663, filed on Apr. 26, 2012, provisional application No. 61/616,721, filed on Mar. 28, 2012.

(30) Foreign Application Priority Data

Mar. 23, 2012 (GB) ..... 1205136.3
Apr. 17, 2012 (GB) ..... 1206777.3

(51) Int. Cl.
*H01J 49/06* (2006.01)

(52) U.S. Cl.
CPC ..... *H01J 49/068* (2013.01); *H01J 49/065* (2013.01); *H01J 49/066* (2013.01); *Y10T 29/49126* (2015.01)

(58) Field of Classification Search
CPC ..... H01J 49/06; H01J 49/062; H01J 49/065; H01J 49/066; H01J 49/068; H01J 29/82
See application file for complete search history.

(56) References Cited

U.S. PATENT DOCUMENTS 6,281,508 B1 * 8/2001 Lee ..... B82Y 15/00 250/396 R
6,576,898 B2 6/2003 Waki
(Continued)

FOREIGN PATENT DOCUMENTS

GB 2366072 A * 2/2002 ..... H01J 49/063
WO WO 2009037483 A2 * 3/2009 ..... H01J 49/062

*Primary Examiner* — David E Smith
(74) *Attorney, Agent, or Firm* — Diederiks & Whitelaw, PLC

(57) ABSTRACT

A method of constructing an ion guide is disclosed comprising providing an elongated spine member and a plurality of plates. Each plate comprises an aperture therethrough for receiving the spine member and at least one electrode for use in guiding ions. The apertures of the plates are arranged around the spine member and the plates are arranged along the spine member. The plates are then locked in position on the spine member such that the plates are fixed axially with respect to the spine member and so that the electrodes of the plates are arranged so as to form an array of electrodes for use in guiding ions.

50 Claims, 5 Drawing Sheets

(56) References Cited

U.S. PATENT DOCUMENTS

| | | | | |
|---|---|---|---|---|
| 6,849,846 | B2 * | 2/2005 | Bertsch | H01J 49/40 250/287 |
| 6,891,153 | B2 | 5/2005 | Bateman et al. | |
| 7,351,963 | B2 | 4/2008 | Rebettge et al. | |
| 7,781,728 | B2 | 8/2010 | Senko et al. | |
| 2002/0148959 | A1 * | 10/2002 | Weiss | F24F 11/0012 250/288 |
| 2003/0178564 | A1 * | 9/2003 | Kernan | H01J 49/063 250/292 |
| 2010/0096541 | A1 * | 4/2010 | Okumura | H01J 49/065 250/281 |
| 2012/0298853 | A1 * | 11/2012 | Kurulugama | H01J 49/065 250/282 |
| 2014/0339414 | A1 * | 11/2014 | Loboda | H01J 49/26 250/281 |

* cited by examiner

ION GUIDE CONSTRUCTION METHOD

CROSS REFERENCE TO RELATED APPLICATIONS

This application is the National Stage of International Application No. PCT/GB2013/050643, filed 15 Mar. 2013, which claims priority from and the benefit of U.S. Provisional Patent Application Ser. No. 61/616,721 filed on 28 Mar. 2012, U.S. Provisional Patent Application Ser. No. 61/638,663 filed on 26 Apr. 2012, United Kingdom Patent Application No. 1205136.3 filed on 23 Mar. 2012 and United Kingdom Patent Application No. 1206777.3 filed on 17 Apr. 2012. The entire contents of these applications are incorporated herein by reference.

BACKGROUND OF THE PRESENT INVENTION

The present invention relates to a method of constructing an ion guide, an ion guide or component of an ion guide, an annular ion guide, an ion mobility spectrometer, a Time of Flight mass analyser and a mass spectrometer.

Ion guides are known comprising a plurality of electrodes mounted between two printed circuit boards. The electrodes which are mounted between the two printed circuit boards each comprise an aperture through which ions are transmitted in use.

GB-2416915 discloses an RF multipole rod system.

GB-2451239 discloses a microfabricated stacked ring electrode ion guide assembly.

WO 2008/157019 discloses an ion transport device and modes of operation thereof.

EP-1505635 discloses an ion guide comprising two interleaved comb arrangements.

It is desired to provide an improved ion guide and an improved method of constructing such an ion guide.

SUMMARY OF THE PRESENT INVENTION

According to an aspect of the present invention there is provided a method of constructing an ion guide comprising:

providing an elongated spine member;

providing a plurality of plates, each plate comprising an aperture therethrough for receiving the spine member and at least one electrode for use in guiding ions;

arranging the apertures of the plates around the spine member and translating the plates along the spine member;

locking the plates in position on the spine member such that the plates are fixed axially with respect to the spine member and so that the electrodes of the plates are arranged so as to form an array of electrodes for use in guiding ions.

The present invention provides a simple and effective method of constructing an ion guide.

Various different methods of locking the plates in place on the spine member are contemplated. All of the plates may be locked in place using the same method or some plates may be locked in place using one of the methods described and other plates in the same ion guide may be locked in place using another of the methods decribed.

Different ones of the plates may have different sized or shaped apertures and the spine member may vary in size or shape along its axial length. The plates may then be translated axially along the spine member until they become locked at different axial positions. Preferably, the different axial positions at which the plates become locked is determined by interference fit between the different apertures and the spine member.

According to an alternative locking method, the spine member may have a plurality of recesses that are axially spaced along its outer surface. The apertures in the plates may be sized and configured such that the plates are translated or forced along the spine member until each plate becomes axially locked in one of the recesses.

According to an alternative locking method, the aperture in each plate comprises a first open portion configured to fit loosely around the spine member, and a second open portion adjoined to the first open portion and which is configured to fit tightly around the spine member. The first open portion may be arranged around the spine member and the plate translated freely along the axis of the spine member to its desired axial position. The plate may then be moved radially with respect to the spine member such that the spine member enters the second open portion and becomes locked in position axially with respect to the spine member.

According to an alternative locking method, the method comprises rotating the plates relative to the spine member so as to lock the plates axially in position on the spine member. Preferably, each of the plates comprises at least one locating member and the spine member comprises at least one channel extending longitudinally along the spine member for receiving the at least one locating member, and wherein the plates are translated along the spine member with the at least one locating member received within the at least one channel.

The at least one locating member may be at least one protrusion that protrudes radially inwards from inside of the aperture. Preferably, a plurality of slots are provided in the outer surface of the spine member and spaced along its longitudinal axis, wherein each slot extends around part of the circumference of the spine member. A plate may be rotated circumferentially about the spine member at the location of each slot such that a locating member on each plate enters its respective slot so that the plates can not move axially with respect to the spine member. Preferably, each slot opens at one of its ends into the channel extending longitudinally along the spine member such that the locating member can be translated axially along the spine member within the channel and then rotated into the slot.

Each plate may further comprise a locking hole. The locking holes in the plates may be aligned and a locking member may be inserted through the locking holes so as to prevent the plates moving relative to each other by rotating circumferentially about the spine member. Preferably the locking member is a rod.

Adjacent plates may be electrically interconnected with each other. The method may comprise locking one of the plates into position adjacent another of the plates such that an electrical connector on the one of the plates makes electrical contact with an electrical connector on the another of the plates. The electrical connector on one of the plates may comprise a resilient or sprung electrical connector or a conductive pad and/or the electrical connector on the another of the plates may comprise a conductive pad or a resilient or sprung electrical connector.

An electrical connector or electrical cable may be arranged within the spine member for supplying voltages to the plates or to the electrodes on the plates.

The plates may at least partially be formed from one or more printed circuit boards. Alternatively, each entire plate may be an electrode.

The at least one electrode in each plate may comprise one or more apertured electrodes through which ions may travel in use. The one or more apertured electrodes may be formed by one or more openings through the plate and electrode material arranged around the periphery of the one or more openings. For example, the opening and/or the electrode is preferably circular, although other shapes are also contemplated. Preferably, the electrode material surrounds the entire periphery of the opening.

Alternatively, the at least one electrode in each plate may be formed by providing one or more openings through the plate and one or more or multiple electrodes may be arranged around the periphery of the one or more openings. For example, plates having multiple electrodes arranged around each opening could be used to form a multipole, such as a quadrupole, hexapole or octapole. Voltages may be supplied to these multiple electrodes so as to guide ions, filter ions or eject ions.

According to an embodiment the at least one electrode in each of the plurality of plates are arranged so as to form: (i) one or more ion tunnel ion guides wherein the diameter of one or more apertured electrodes or the diameter of one or more openings through the plates remains substantially constant along the length of the ion guide; (ii) one or more ion guides wherein the diameter of one or more apertured electrodes or the diameter of one or more openings through the plates changes along the length of the one or more ion guides; (iii) one or more ion funnel ion guides wherein the diameter of one or more apertured electrodes or the diameter of one or more openings through the plates substantially increases and/or decreases along the length of the one or more ion guides; (iv) one or more ion guides having one or more spiral, curved, helical or tortuous ion guiding paths; (v) one or more conjoined ion guides wherein ions may be transferred radially from a first ion guiding path into a second different ion guiding path; (vi) n ion guides which merge into m ion guides, wherein n>m; or (vii) n ion guides which split into m ion guides, wherein m>n. According to an embodiment each plate may comprise two or more ion guiding apertures or openings and in use ions may be arranged to travel in the same or opposite directions through the two or more apertures or openings. According to another embodiment the cross-sectional profile of the one or more apertures or openings in the plates may change along the length of the ion guide. For example, the ion guide may be arranged to convert a beam of ions having a first cross-sectional profile (e.g. circular) into a beam of ions having a second different cross-sectional profile (e.g. rectangular).

Alternatively, the at least one electrode in each plate may be arranged around the outer periphery of the plate.

At least some of the plates may be generally circular or annular shaped.

At least some of the plates may comprise one or more teeth or other projecting members around the outer circumference.

The method may further comprise forming an outer array of electrodes. The outer array is preferably formed from a plurality of electrodes having openings through which ions may travel in use. The step of forming the outer array of electrodes may comprise slotting a plurality of electrodes into one or more printed circuit boards. The method may further comprise locating the plurality of plates on the spine member within the outer array of electrodes so that an annular ion guiding region is formed between the plates and the outer array of electrodes.

According to another aspect of the present invention there is provided an ion guide or inner component of an ion guide comprising:

an elongated spine member; and a plurality of plates, wherein each plate comprises an aperture therethrough and at least one electrode for use in guiding ions;

wherein the apertures of the plates are arranged around the spine member, and wherein the plates are locked in position on the spine member such that the plates are fixed axially with respect to the spine member and so that the electrodes of the plates are arranged so as to form an array of electrodes for use in guiding ions.

According to an embodiment the at least one electrode in each of the plurality of plates are arranged so as to form: (i) one or more ion tunnel ion guides wherein the diameter of one or more apertured electrodes or the diameter of one or more openings through the plates remains substantially constant along the length of the ion guide; (ii) one or more ion guides wherein the diameter of one or more apertured electrodes or the diameter of one or more openings through the plates changes along the length of the one or more ion guides; (iii) one or more ion funnel ion guides wherein the diameter of one or more apertured electrodes or the diameter of one or more openings through the plates substantially increases and/or decreases along the length of the one or more ion guides; (iv) one or more ion guides having one or more spiral, curved, helical or tortuous ion guiding paths; (v) one or more conjoined ion guides wherein ions may be transferred radially from a first ion guiding path into a second different ion guiding path; (vi) n ion guides which merge into m ion guides, wherein n>m; or (vii) n ion guides which split into m ion guides, wherein m>n. According to an embodiment each plate may comprise two or more ion guiding apertures or openings and in use ions may be arranged to travel in the same or opposite directions through the two or more apertures or openings. According to another embodiment the cross-sectional profile of the one or more apertures or openings in the plates may change along the length of the ion guide. For example, the ion guide may be arranged to convert a beam of ions having a first cross-sectional profile (e.g. circular) into a beam of ions having a second different cross-sectional profile (e.g. rectangular).

The ion guide or the inner ion component of the ion guide may be formed according to any of the methods described above.

According to another aspect of the present invention there is provided an annular ion guide comprising:

an inner component as described above; and an outer array of electrodes;

wherein the inner component is located within the outer array of electrodes so that an annular ion guiding region is formed, in use, between the inner and outer arrays of electrodes.

According to another aspect of the present invention there is provided an ion mobility spectrometer or separator comprising an ion guide as described above.

According to another aspect of the present invention there is provided a Time of Flight mass analyser comprising an ion guide as described above.

According to another aspect of the present invention there is provided a mass spectrometer comprising an ion guide, an ion mobility spectrometer, or a Time of Flight mass analyser as described above.

According to another aspect of the present invention there is provided a method of constructing an ion guide comprising:

forming an array or inner array of electrodes by sliding or translating a plurality of first electrodes or first substrates along a core member and then rotating at least some of the first electrodes or first substrates relative to the core member so that at least some of the first electrodes or first substrates are rotated into position on the core member.

The array or inner array of electrodes which is formed preferably forms an inner array of electrodes of an annular ion guide. However, other embodiments are contemplated wherein the array of electrodes formed may be used in other types of ion guides including ion guides wherein ions are not guided through an annular ion guiding volume. According to an embodiment, for example, an ion guide may be constructed having two ion guiding regions wherein ions are transferred in use from one ion guiding region to another ion guiding region.

According to the preferred embodiment the core member is maintained substantially stationary and at least some of the one or more first electrodes or first substrates are rotated (separately) into position on the core member.

However, according to a less preferred embodiment at least some of the one or more first electrodes or first substrates may be maintained substantially stationary and the core member may be rotated so that at least some of the one or more first electrodes or first substrates are moved into position on the core member.

At least some of the first electrodes or first substrates are generally circular or annular shaped and have an internal aperture which enables the first electrodes or first substrates to be slid or otherwise translated along at least a portion of the length of the core member.

The internal apertures preferably have a diameter or width which is greater than an outer diameter or width of the core member.

One or more of the plurality of first electrodes or first substrates preferably comprise one or more locating members for locating the one or more first electrodes or first substrates into position on the core member.

The core member preferably comprises one or more channels or grooves and the step of sliding or translating the plurality of first electrodes or first substrates onto the core member preferably comprises sliding or translating the plurality of first electrodes or first substrates along the core member so that the one or more locating members are received within and/or slide along the one or more channels or grooves.

The one or more locating members are preferably retained within the one or more channels or grooves as they are being slid or translated along the core member.

The core member preferably comprises one or more slots or receiving members and the one or more locating members are preferably rotated into the one or more slots or receiving members to secure the plurality of first electrodes or first substrates into position on the core member.

The first electrodes or first substrates are preferably at least partially formed from one or more printed circuit boards.

The first electrodes or first substrates preferably comprise one or more metallic or conductive surfaces on at least a portion of the first electrodes or first substrates.

At least some of the first electrodes or first substrates preferably comprise one or more teeth or other projecting members around the circumference of the first electrodes or first substrates.

According to an embodiment the preferred method further comprises rotating a first electrode or first substrate into position adjacent another first electrode or first substrate such that a first electrical connector on one of the first electrodes or first substrates makes electrical contact with a second electrical connector on the other of the first electrodes or first substrates.

The first electrical connector preferably comprises a resilient or sprung electrical connector or a conductive pad.

The second electrical connector preferably comprises a conductive pad or a resilient or sprung electrical connector.

According to an embodiment the method further comprises inserting an electrical connector or electrical cable within the core member.

According to an embodiment the method further comprises forming an outer array of electrodes.

The step of forming the outer array of electrodes preferably comprises slotting a plurality of second electrodes or second substrates each having one or more apertures into one or more longitudinal printed circuit boards.

The second electrodes or second substrates are preferably formed at least partially from one or more printed circuit boards.

According to an embodiment the method further comprises locating the inner array of electrodes within the outer array of electrodes so that an annular ion guiding region is formed between the inner and outer arrays of electrodes.

According to an aspect of the present invention there is provided an ion guide or an inner component of an ion guide comprising:

a core member; and an array or Inner array of electrodes comprising a plurality of first electrodes or first substrates;

wherein the ion guide or component is assembled by sliding or translating the plurality of first electrodes or first substrates along the core member and then rotating at least some of the first electrodes or first substrates relative to the core member so that at least some of the first electrodes or first substrates are rotated into position on the core member.

According to an aspect of the present invention there is provided an annular ion guide comprising:

an inner component as described above; and an outer array of electrodes;

wherein the inner component is located within the outer array of electrodes so that an annular ion guiding region is formed, in use, between the Inner and outer arrays of electrodes.

According to an aspect of the present invention there is provided an ion mobility spectrometer or separator comprising an ion guide as described above.

According to an aspect of the present invention there is provided a Time of Flight mass analyser comprising an ion guide as described above.

According to another aspect of the present invention there is provided a mass spectrometer comprising an ion guide or an ion mobility spectrometer or separator as described above.

An advantage of the preferred method of forming an ion guide (preferably annular ion guide) is that the method allows accurate electrode to electrode positional matching between inner and outer electrode sets. The preferred method also has advantages in terms of accuracy of alignment, ease of miniaturisation, ease of construction and cost.

According to a preferred embodiment the ion guide (preferably annular ion guide) once constructed may be used as a component of a mass spectrometer to guide ions and preferably as part of an ion mobility separator or spectrometer wherein ions are separated according to their ion mobility. Ions are preferably confined within the preferred annular ion guide in a gap or annular ion guiding volume or region between a suspended inner set of electrodes which is preferably located within an outer set of electrodes which preferably surrounds the inner set of electrodes. However, according to other embodiments the ion guide may simply comprise a plurality of electrodes each having one or more electrodes through which ions are transmitted in use.

According to the preferred embodiment the inner set of electrodes preferably comprises a plurality of printed circuit boards wherein the outer surfaces of the printed circuit boards form electrodes. The printed circuit boards are preferably stacked on a mechanical pillar or other core member so that the printed circuit boards are accurately positioned.

According to an embodiment electrical connections between adjacent printed circuit boards may be made using sprung or spring contacts or connections. The spring contacts preferably avoid the electrical connections between printed circuit boards influencing or being influenced by the precise physical position of the printed circuit boards.

According to an embodiment the printed circuit boards comprising the inner electrodes may be accurately positioned by sliding the inner electrodes down a comb-like shaft or core member. The printed circuit boards may then be rotated through a small angle into a slot at a required distance from a neighboring printed circuit board.

An advantage of the preferred embodiment is that the assembly of printed circuit boards comprising the inner electrodes can be manufactured without undue complexity.

According to an embodiment the printed circuit boards have conductive pads designed so that, during assembly, sprung contacts on a printed circuit board contact the conductive pad of a neighbouring printed circuit board (or vice versa). Furthermore, when a printed circuit board is rotated into its final position the spring contact is preferably arranged so that it rests on the conductive area of the pad giving a close to ideal wiping contact action.

The above method of construction results in the construction of a central array of inner electrodes. The array of inner electrodes is then preferably surrounded or otherwise enclosed by an array of outer electrodes. When the array of inner electrodes is suspended within the outer electrodes an annular ion guide is preferably formed. However, other non-annular ion guides are also contemplated comprising just an array of inner electrodes (i.e. it is not essential to provide an array of outer electrodes).

An ion guide constructed according to the preferred embodiment may be used for a number of different applications including as an ion guide or as an ion mobility separator.

According to a particularly preferred embodiment the ion guide may be constructed so as to have a helical ion guiding path.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A method of constructing an ion guide according to a preferred embodiment of the present invention will now be described.

According to the preferred embodiment an ion guide may be formed wherein an array of inner electrodes is positioned within a surrounding supporting structure preferably comprising a plurality of outer electrodes.

An inner array of electrodes is preferably constructed of electrode plates. The electrode plates may be made from metal and may be separated electrically from each other by insulators. Once constructed, each metal plate or electrode may be connected to a voltage source. This may be accomplished, for example, using a combination of wires and/or printed circuit board tracks.

According to an embodiment the assemblies of electrodes may be supported on at least one side with the result that the support side preferably does not form part of the ion optical guide.

The method of constructing the ion guide according to the preferred embodiment has the advantage that the array of inner electrodes can be positioned accurately, that reliable connections can be created to each electrode, that an assembly is created that is intrinsically less complex to manufacture than current methods of manufacture, that the cost of both the parts and the assembly procedure is relatively inexpensive and that a design is created that lends itself to miniaturization.

It will be apparent, therefore, that the method and apparatus according to the preferred embodiment represent a significant advance in the art.

Figure 1:
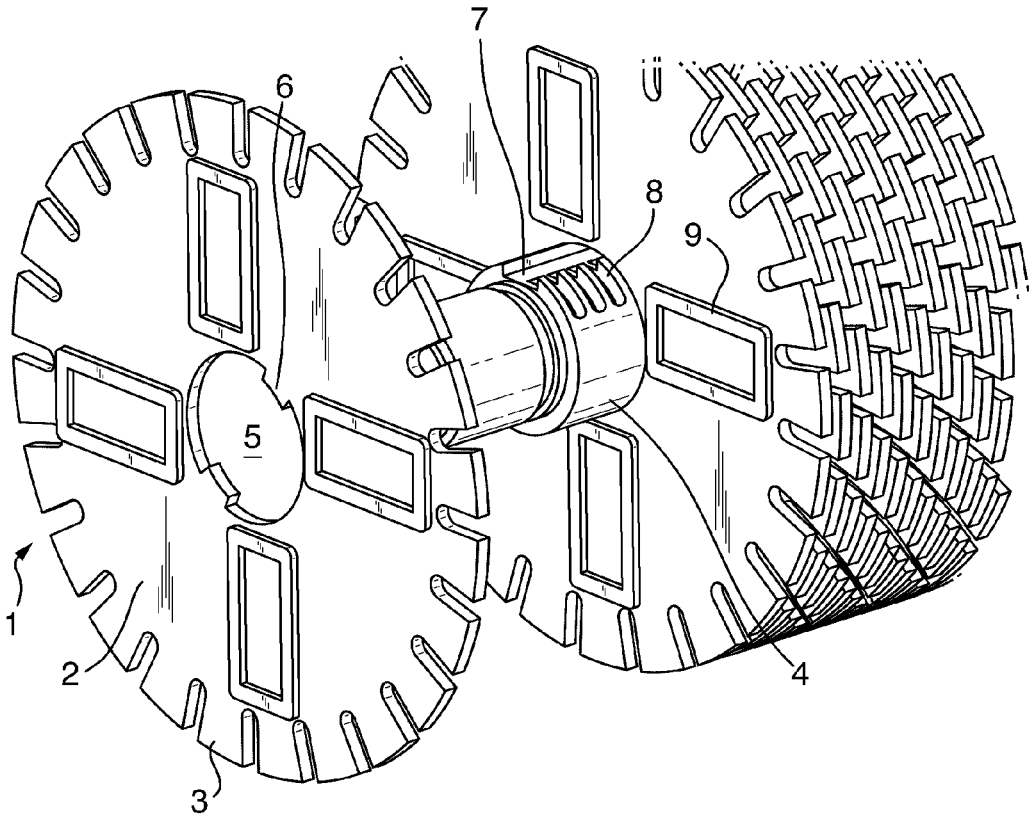
FIG. 1 shows a circular printed circuit board formed as a disc with conductive electrodes arranged around the circumference of the disc wherein the printed circuit board is in the process of being mounted onto a central core member so that it may then be rotated into a slotted final position on the central core member adjacent a neighbouring printed circuit board.

FIG. 1 shows aspects of a preferred embodiment of the present invention and shows the construction of an array of inner electrodes 1 which are mounted upon an inner core 4. The array of inner electrodes 1 preferably comprises circular printed circuit boards 2 which preferably have a plurality of teeth 3 around the outer circumference of the printed circuit boards 2. The teeth 3 are preferably plated with conductors so that they form electrodes. Some of the electrodes may be directly or indirectly connected to others on the same printed circuit board 2.

According to an embodiment resistors and/or capacitors and/or other electronic components may be fitted onto each circular printed circuit board 2 so that RF (radio frequency) voltages and/or various DC voltage drops may be applied to or maintained along the electrodes.

It will be apparent from FIG. 1 that each circular printed circuit board 2 can be assembled onto a central rod or core member 4 and may then be rotated into position next to another printed circuit board. Each printed circuit board 2 preferably has an inner aperture 5 with one or more depending members 6 around the circumference of the Inner aperture 5. When a circular printed circuit board 2 is mounted on to the central core 4 the one or more depending members 6 preferably slide along one or more channels or grooves 7 provided along an outer surface of the central core member 4. Each individual circular printed circuit board 2 may then be rotated into final position by rotating the printed circuit board 2 into one or more slots 8 which are preferably provided along the length of the central core member 4 and which preferably communicate with the channel 7. The one or more depending members 6 on the circular printed circuit board 2 preferably engage with the slot(s) 8 and the circular printed circuit board 2 is effectively locked into a fixed position on the central core 4.

According to the preferred embodiment two channels or grooves 7 and two slotted regions 8 or comb-like regions may be formed in the core member 4. The channels 7 and slotted regions 8 are preferably arranged at 180° to each other around the outer circumference of the core member 4. Each printed circuit board 2 which is to be mounted upon the core member 4 preferably comprises two inwardly directed locating members or teeth 6 which are also preferably arranged at 180° to each other around the circumference of a circular aperture 5 provided in the centre of each printed circuit board 2. The printed circuit board discs 2 are then preferably rotated into final position so that the two inwardly directed locating members or teeth 6 are received within opposed slots 8 on the core member 4.

According to an embodiment the slots 8 may have a profile which allows the inwardly directed teeth or locating members 6 on the inner electrodes 1 or printed circuit boards 2 to rotate into position in a first direction but which substantially resist the inner electrodes 4 or printed circuit boards 2 being rotated out of position in a second direction which is opposed to the first position.

As a printed circuit board 2 is rotated into a final position one or more sprung connectors (not shown) on a surface of the printed circuit board 2 are preferably brought into direct electrical contact with a conductive pad 9 on an adjacent printed circuit board which is preferably already located in position on the central core 4 (or vice versa).

Figure 2:
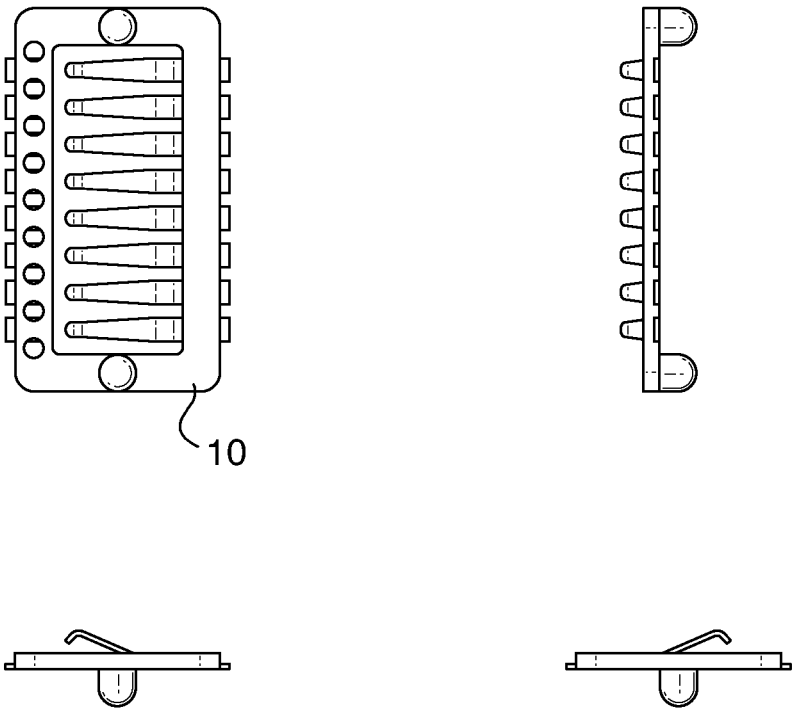
FIG. 2 shows various profiles of a sprung connector which may be used to form an electrical connection between neighbouring printed circuit board discs.

FIG. 2 shows various profiles of a set or group of eight sprung connectors 10 which may be used according to an embodiment to provide electrical interconnection between adjacent inner printed circuit boards 2. It will be understood that other embodiments are contemplated wherein a single connector 10 is provided or wherein two, three, four, five, six, seven, nine, ten or more than ten connectors 10 are provided.

The sprung connectors 10 are preferably aligned or otherwise arranged so that as a printed circuit board 2 is being rotated into final position on the central core 4, the sprung connectors 10 on the printed circuit board 2 avoid touching other electrical and other components which may be mounted on an adjacent printed circuit board 2 such as capacitors, resistors, other electronic components and connectors.

Once a printed circuit board 2 is rotated into position, the sprung connectors 10 on one printed circuit board 2 are preferably brought into contact with one or more conductive pads 9 on a neighboring printed circuit board 2. The sprung connectors 10 preferably enable electrical connection between the two printed circuit boards 2 to be made and it will be apparent that all the printed circuit boards 2 forming the array of inner electrodes 1 mounted on the core member 4 may effectively be maintained in electrical connection with each other. In this manner several hundred different electrodes 1 can be energised with a multitude of RF and/or DC potentials and advantageously only the first and/or last printed circuit board 4 in the stack or array of inner electrodes 1 may make external electrical contact with e.g. an external voltage source.

According to an embodiment adjacent inner electrodes 1 may be maintained in use at opposite phases of an RF voltage and/or a DC voltage gradient may be maintained along at least a portion of the axial length of the ion guide. According to an embodiment one or more transient DC voltages or potentials may be applied to the electrodes forming the ion guide so that ions may be urged along the length of the ion guide.

The central rod or core member 4 upon which the array of inner electrodes 1 is mounted may be in tubular form although this is not essential. If the central rod or core member 4 comprises one or more internal channels then one or more electrical cables or other conductors may be assembled within the one or more channels and may pass along the length of the core member 4. According to an embodiment all electrical connections may exit the assembly from just one end despite both end printed circuit boards 4 having their own set of distinct external electrical connections.

Figure 3:
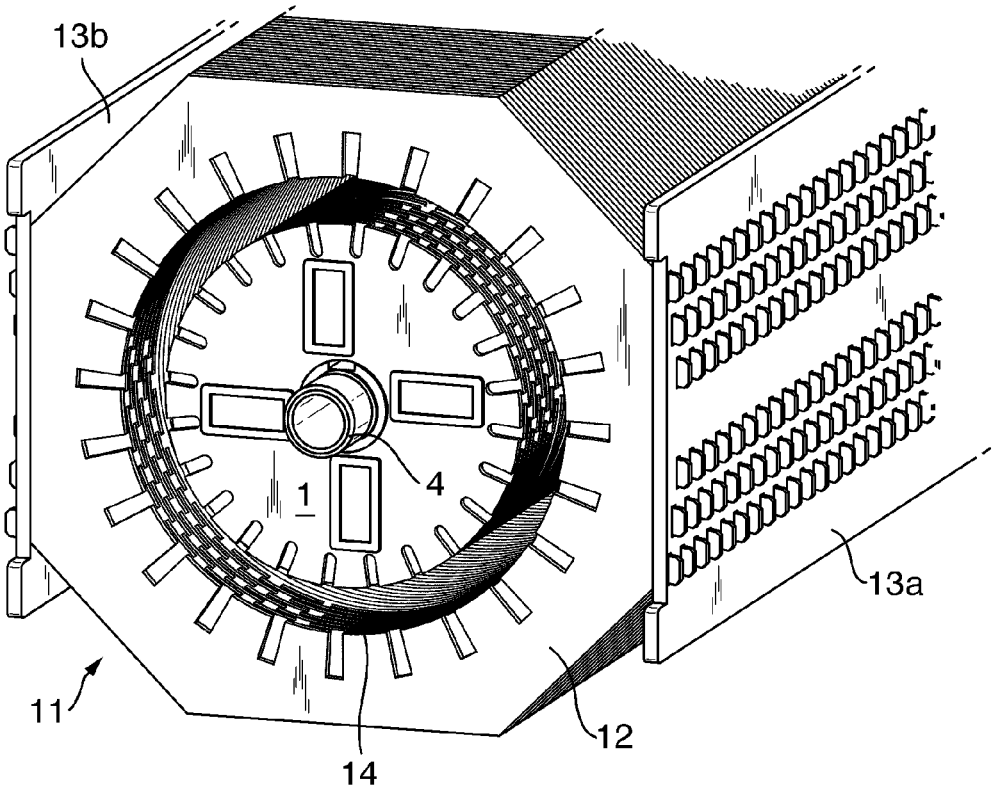
FIG. 3 shows an array of inner electrodes located within an array of outer electrodes having an hexagonal outer profile, wherein the array of outer electrodes are mounted between two parallel printed circuit boards so that an annular ion guide region is formed between the array of inner electrodes and the array of outer electrodes.

FIG. 3 depicts how an array of inner electrodes 1 mounted on a central core 4 may be suspended within an array of outer electrodes 11 in order to form an annular electrode assembly according to an embodiment of the present invention. The outer array of electrodes 11 can be constructed in different ways. According to an embodiment a set of octagonal printed circuit boards 12 may be slotted into and between two long rectangular printed circuit boards 13*a*,13*b*. The octagonal printed circuit boards 12 preferably each comprise an aperture 14 through which the array of inner electrodes 1 is preferably inserted (or vice versa).

Various alternative embodiments are contemplated. For example, the array of outer electrodes 11 may comprise printed circuit boards which have an outer profile which is non-octagonal. For example, the array of outer electrodes 11 may have an outer profile which is substantially triangular, square, rectangular, pentagonal, hexagonal, septagonal or which has more than eight sides.

An annular ion guide region is preferably formed between the array of inner electrodes 1 and the array of outer electrodes 11 and preferably has a circular annulus in cross-section. However, less preferred embodiments are contemplated wherein the ion guide region has in cross section an ion guiding region comprising an annulus wherein the inner and/or outer profile of the annulus is non-circular e.g. elliptical or oval.

Although according to the preferred embodiment each circular printed circuit board 2 is preferably rotated into position during the process of constructing the inner array of electrodes 1 on the inner core 4, twisting or rotating each circular printed circuit board 2 individually (and sequentially) into position is not essential. Other less preferred embodiments are contemplated wherein the printed circuit boards 2 may all be held stationary or may be jigged and the central rod or core member 4 may instead then be rotated. This embodiment allows more components to be provided on each printed circuit board 2 but the rotational force required to rotate the central rod or core member 4 needs to be sufficient so as to overcome any small misalignment of all the circular printed circuit boards 2 at the same time. This method may also be used to create an ion guide that is enclosed at one end e.g. an ion guide that is substantially semispherical.

Ion guides with long path lengths for use, for example, in high resolution ion mobility spectrometry applications may be formed by assembling multiple arrays of inner electrodes 1 next to one another. According to an embodiment square or hexagonal rather than circular printed circuit boards may be stacked and the stacks may be arranged into a matrix.

Although the above description of the preferred embodiment above relates primarily to the construction of an annular ion guide, it should be understood that the present invention also extends to embodiments wherein an ion guide is constructed from a single array of electrodes. It should be understood that it is not essential for two arrays of electrodes 1,11 to be provided and for there to be an annular ion guiding volume formed between the two arrays of electrodes 1,11.

Figure 4:
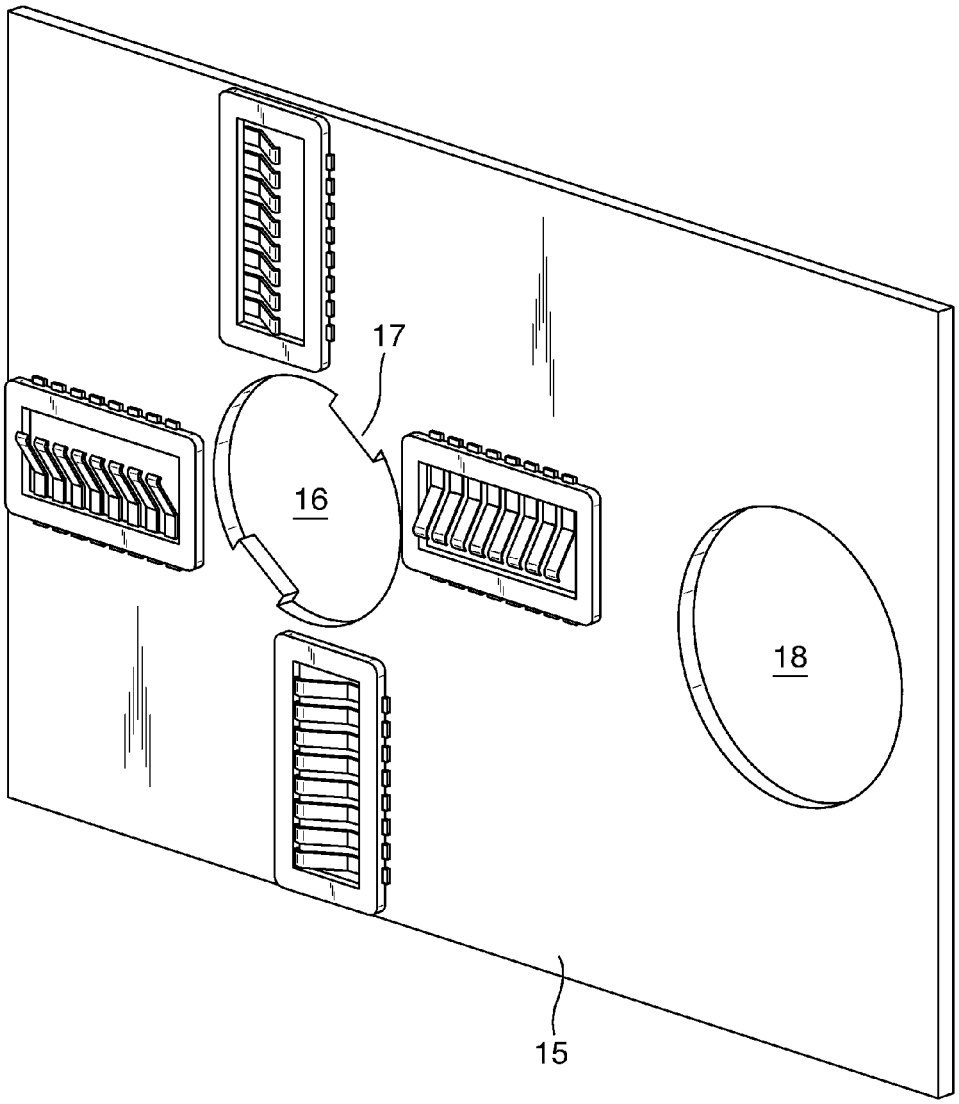
FIG. 4 shows an electrode plate having an aperture for engaging a core and a separate opening for guiding ions.

For example, FIG. 4 shows an electrode plate 15 for use in forming an alternative ion guide that does not require an outer array of electrodes. A plurality of these electrode plates 15 are preferably used to form the ion guide. The electrode plate 15 is similar to each electrode plate used in the embodiment described with reference to FIG. 1 in that it has an aperture 16 and associated locating members 17 for locking the plate 15 on to a core, as is described in relation to FIG. 1. This aperture 16 is shown on the left hand side of FIG. 4. However, the plate additionally includes an opening 18 preferably surrounded by electrode material and through which ions preferably travel in use. This opening 18 is shown on the right side of FIG. 4. A plurality of these plates 15 are preferably arranged on the core 4 and locked in place such that the openings 16,18 are preferably aligned. Voltages can then be applied to the electrode material around the openings so as to guide ions along the ion guide through the openings 18.

Figure 5:
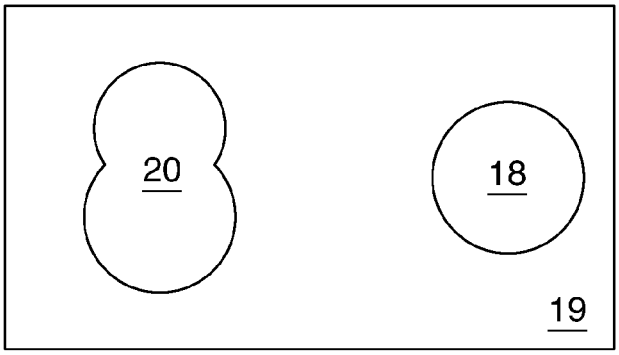
FIG. 5 shows an electrode plate similar to FIG. 4 except having a different aperture for engaging the core.

FIG. 5 shows an electrode plate 19 for use in forming another ion guide. This electrode plate 19 has an opening 18 for guiding ions that is the same as that shown in FIG. 4. However, the electrode plate 19 of FIG. 5 has a different aperture 20 for locking the plate 19 in place on the core 4. The aperture 20 in each plate 19 comprises a first open portion configured to fit loosely around the core 4 and a second open portion adjoined to the first open portion and which is configured to fit tightly around the core 4. The first and second open portions are preferably formed from part-circles of different radii. In order to construct the ion guide the first open portion is arranged around the core 4 and the plate 19 is translated freely along the axis of the core 4 to its desired axial position. The plate 19 is then preferably moved radially with respect to the core 4 such that the core 4 enters the second open portion and becomes locked in position axially with respect to the core 4. In this embodiment the core 4 need not be slotted since it does not need to interact with locating members in the aperture 20. A plurality of these electrode plates 19 are preferably aligned and locked on the core 4 so that ions can be guided through the openings 18.

Figure 6:
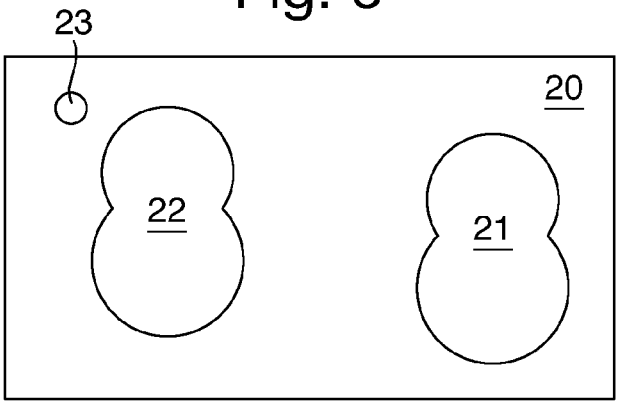
FIG. 6 shows an electrode plate similar to FIG. 5 except having a different opening for guiding ions.

FIG. 6 shows an electrode plate 20 for forming an ion guide that is substantially the same as that shown in FIG. 5 except that the ion guiding opening 21 is of the same shape as the aperture 22 for locking the plate 20 onto the core 4. It is contemplated that the ion guiding opening 21 may be any other shape and/or different shapes in different plates of the same ion guide. FIG. 6 also shows a locking hole 23. In this embodiment the locking hole 23 is located at the top left portion of the plate, although it may be located anywhere. The plurality of plates 20 may be aligned on the core 4 such that the locking holes 23 are aligned. A locking rod may then be inserted through the locking holes 23 of the plates 20 so as to prevent the plates 20 rotating about the core 4 relative to each other. It will be appreciated that locking holes 23 may be provided on any of the plates described in the present application.

Figure 7:
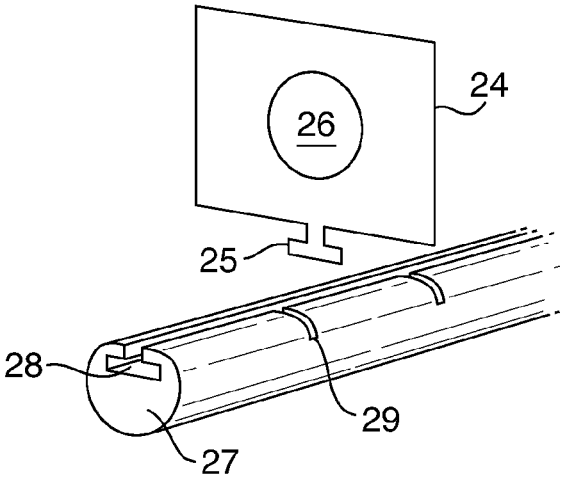
FIG. 7 shows another method of forming an ion guide according to another embodiment of the present invention.

FIG. 7 shows another embodiment wherein each electrode plate 24 comprises a locating member 25 and an ion guiding opening 26. The core 27 has a channel 28 for receiving the locating member 25 so that the plate 24 can engage the core 27 and be translated along it. The core 27 also has axially spaced slots 29 extending part way around its circumference. A plate 24 located at each slot 29 may be rotated in the slot 29 so as to lock it axially in place on the core 27. It is also contemplated herein that the slots 29 could be configured such that the locating members 25 may be inserted directly into the slots 29 and then rotated into a locking position, rather than having to first engage a longitudinal groove 28 and be translated along the core 27.

Although the present invention has been described with reference to preferred embodiments, it will be understood by those skilled in the art that various changes in form and detail may be made without departing from the scope of the invention as set forth in the accompanying claims.

The invention claimed is:

1. A method of constructing an ion guide comprising:

providing an elongated spine member;

providing a plurality of plates, each plate comprising an aperture therethrough for receiving the spine member and at least one electrode for use in guiding ions; and arranging the apertures of the plates around the spine member, sequentially translating each plate of the plurality of plates along the spine member and then locking each plate in position on said spine member such that the plates are fixed axially with respect to the spine member and so that the electrodes of the plates are arranged so as to form an axial array of electrodes for use in guiding ions.

2. A method as claimed in claim 1, wherein different ones of the plates have different sized or shaped apertures and the spine member varies in size or shape along an axial length of the spine member, and wherein the plates are translated axially along the spine member until the plates become locked at different axial positions.

3. A method as claimed in claim 2, wherein the different axial positions at which the plates become locked is determined by interference fit between the different apertures and the spine member.

4. A method as claimed in claim 1, wherein the spine member has a plurality of recesses that are axially spaced along an outer surface of the spine member, wherein the apertures in the plates are sized and configured such that the plates are translated or forced along the spine member until each plate becomes axially locked in one of the recesses.

5. A method as claimed in claim 1, wherein the aperture in each plate comprises a first open portion configured to fit loosely around the spine member, and a second open portion adjoined to the first open portion and which is configured to fit tightly around the spine member, wherein the first open portion is arranged around the spine member and the plate is translated freely along the axis of the spine member to a desired axial position, and wherein the plate is then moved radially with respect to the spine member such that the spine member enters the second open portion and becomes locked in position axially with respect to the spine member.

6. A method as claimed in claim 1, comprising rotating said plates relative to said spine member so as to lock said plates axially in position on the spine member.

7. A method as claimed in claim 6, wherein each of said plates comprises at least one locating member and said spine member comprises at least one channel extending longitudinally along said spine member for receiving said at least one locating member, and wherein said plates are translated along said spine member with said at least one locating member received within said at least one channel.

8. A method as claimed in claim 7, wherein the at least one locating member is at least one protrusion that protrudes radially inwards from inside of the aperture.

9. A method as claimed in claim 7, wherein a plurality of slots are provided in an outer surface of the spine member and spaced along a longitudinal axis of the spine member, wherein each slot extends around part of a circumference of the spine member, and wherein a plate is rotated circumferentially about the spine member at the location of each slot such that a locating member on each plate enters its respective slot so that the plates can not move axially with respect to the spine member.

10. A method as claimed in claim 9, wherein each slot opens at one end into the channel extending longitudinally along said spine member such that the locating member can be translated axially along the spine member within the channel and then rotated into the slot.

11. A method as claimed in claim 1, wherein each plate further comprises a locking hole, wherein the locking holes in the plates are aligned and a locking member is inserted through the locking holes so as to prevent the plates moving relative to each other by rotating circumferentially about the spine member.

12. A method as claimed in claim 1, further comprising locking one of said plates into position adjacent another of said plates such that an electrical connector on said one of said plates makes electrical contact with an electrical connector on said another of said plates.

13. A method as claimed in claim 12, wherein the electrical connector on said one of said plates comprises a resilient or sprung electrical connector or a conductive pad or wherein the electrical connector on said another of said plates comprises a conductive pad or a resilient or sprung electrical connector.

14. A method as claimed in claim 1, further comprising inserting an electrical connector or electrical cable within said spine member for supplying voltages to said plates or to said electrodes on said plates.

15. A method as claimed in claim 1, wherein said plates are at least partially formed from one or more printed circuit boards.

16. A method as claimed in claim 1, wherein said at least one electrode in each plate comprises one or more apertured electrodes through which ions may travel in use.

17. A method as claimed in claim 16, wherein said at least one apertured electrode is formed by one or more openings through the plate and electrode material arranged around a periphery of the one or more openings.

18. The method of claim 1, wherein said at least one electrode in each plate is formed by providing one or more openings through the plate and one or more electrodes arranged around a periphery of the one or more openings.

19. A method as claimed in claim 16, wherein the at least one electrode in each of said plurality of plates are arranged so as to form: (i) one or more ion tunnel ion guides wherein the diameter of one or more apertured electrodes or the diameter of one or more openings through the plates remains substantially constant along the length of the ion guide; (ii) one or more ion guides wherein the diameter of one or more apertured electrodes or the diameter of one or more openings through the plates changes along the length of the one or more ion guides; (iii) one or more ion funnel ion guides wherein the diameter of one or more apertured electrodes or the diameter of one or more openings through the plates substantially increases or decreases along the length of the one or more ion guides; (iv) one or more ion guides having one or more spiral, curved, helical or tortuous ion guiding paths; (v) one or more conjoined ion guides wherein ions may be transferred radially from a first ion guiding path into a second different ion guiding path; (vi) n ion guides which merge into m ion guides, wherein n>m; or (vii) n ion guides which split into m ion guides, wherein m>n.

20. A method as claimed in claim 1, wherein said at least one electrode in each plate is arranged around the outer periphery of said plate.

21. A method as claimed in claim 1, wherein at least some of said plates are generally circular or annular shaped.

22. A method as claimed in claim 1, wherein at least some of said plates comprise one or more teeth or other projecting members around the outer circumference.

23. A method as claimed in claim 1, further comprising forming an outer array of electrodes, preferably formed from a plurality of electrodes having openings through which ions may travel in use.

24. A method as claimed in claim 23, wherein said step of forming said outer array of electrodes comprises slotting a plurality of electrodes into one or more printed circuit boards.

25. A method as claimed in claim 23, further comprising locating said plurality of plates on said spine member within said outer array of electrodes so that an annular ion guiding region is formed between said plates and said outer array of electrodes.

26. An ion guide or inner component of an ion guide comprising:

an elongated spine member; and a plurality of plates, wherein each plate comprises an aperture therethrough and at least one electrode for use in guiding ions;

wherein the apertures of the plates are arranged around the spine member; and wherein each of said plates is locked in position on said spine member such that the plates are fixed axially with respect to the spine member and so that the electrodes of the plates are arranged so as to form an axial array of electrodes for use in guiding ions.

27. An ion guide or inner component as claimed in claim 26, wherein the at least one electrode in each of said plurality of plates are arranged so as to form: (i) one or more ion tunnel ion guides wherein the diameter of one or more apertured electrodes or the diameter of one or more openings through the plates remains substantially constant along the length of the ion guide; (ii) one or more ion guides wherein the diameter of one or more apertured electrodes or the diameter of one or more openings through the plates changes along the length of the one or more ion guides; (iii) one or more ion funnel ion guides wherein the diameter of one or more apertured electrodes or the diameter of one or more openings through the plates substantially increases or decreases along the length of the one or more ion guides; (iv) one or more ion guides having one or more spiral, curved, helical or tortuous ion guiding paths; (v) one or more conjoined ion guides wherein ions may be transferred radially from a first ion guiding path into a second different ion guiding path; (vi) n ion guides which merge into m ion guides, wherein n>m; or (vii) n ion guides which split into m ion guides, wherein m>n.

28. An annular ion guide comprising:

an inner component as claimed in claim 26; and an outer array of electrodes;

wherein said inner component is located within said outer array of electrodes so that an annular ion guiding region is formed, in use, between said inner and outer arrays of electrodes.

29. A method of constructing an ion guide comprising:

forming an array or inner array of electrodes by sliding or translating a plurality of first electrodes or first substrates along a core member and then rotating at least some of said first electrodes or first substrates relative to said core member so that at least some of said first electrodes or first substrates are rotated into position on said core member so that the first electrodes or first substrates become axially fixed on said core member.

30. A method as claimed in claim 29, wherein said core member is maintained substantially stationary and at least some of said one or more first electrodes or first substrates are rotated into position on said core member.

31. A method as claimed in claim 29, wherein at least some of said one or more first electrodes or first substrates are maintained substantially stationary and said core member is rotated so that at least some of said one or more first electrodes or first substrates are moved into position on said core member.

32. A method as claimed in claim 29, wherein at least some of said first electrodes or first substrates are generally circular or annular shaped and have an internal aperture which enables said first electrodes or first substrates to be slid or otherwise translated along at least a portion of a length of said core member.

33. A method as claimed in claim 32, wherein said internal apertures have a diameter or width which is greater than an outer diameter or width of said core member.

34. A method as claimed in claim 29, wherein one or more of said plurality of first electrodes or first substrates comprise one or more locating members for locating said one or more first electrodes or first substrates into position on said core member.

35. A method as claimed in claim 34, wherein said core member comprises one or more channels or grooves and wherein the step of sliding or translating said plurality of first electrodes or first substrates onto said core member comprises sliding or translating said plurality of first electrodes or first substrates along said core member so that said one or more locating members are received within or slide along said one or more channels or grooves.

36. A method as claimed in claim 35, wherein said one or more locating members are retained within said one or more channels or grooves as said one or more locating members are being slid or translated along said core member.

37. A method as claimed in claim 34, wherein said core member comprises one or more slots or receiving members and wherein said one or more locating members are rotated into said one or more slots or receiving members to secure said plurality of first electrodes or first substrates into position on said core member.

38. A method as claimed in claim 29, wherein said first electrodes or first substrates are at least partially formed from one or more printed circuit boards.

39. A method as claimed in claim 38, wherein said first electrodes or first substrates comprise one or more metallic or conductive surfaces on at least a portion of said first electrodes or first substrates.

40. A method as claimed in claim 38, wherein at least some of said first electrodes or first substrates comprise one or more teeth or other projecting members around a circumference of said first electrodes or first substrates.

41. A method as claimed in claim 29, further comprising rotating a first electrode or first substrate into position adjacent another first electrode or first substrate such that a first electrical connector on one of said first electrodes or first substrates makes electrical contact with a second electrical connector on the other of said first electrodes or first substrates.

42. A method as claimed in claim 41, wherein said first electrical connector comprises a resilient or sprung electrical connector or a conductive pad.

43. A method as claimed in claim 41, wherein said second electrical connector comprises a conductive pad or a resilient or sprung electrical connector.

44. A method as claimed in claim 29, further comprising inserting an electrical connector or electrical cable within said core member.

45. A method as claimed in claim 29, further comprising forming an outer array of electrodes.

46. A method as claimed in claim 45, wherein said step of forming said outer array of electrodes comprises slotting a plurality of second electrodes or second substrates each having one or more apertures into one or more longitudinal printed circuit boards.

47. A method as claimed in claim 46, wherein said second electrodes or second substrates are formed at least partially from one or more printed circuit boards.

48. A method as claimed in claim 46, further comprising locating said inner array of electrodes within said outer array of electrodes so that an annular ion guiding region is formed between said inner and outer arrays of electrodes.

49. An ion guide or inner component of an ion guide comprising:

a core member; and an array or inner array of electrodes comprising a plurality of first electrodes or first substrates;

wherein said ion guide or component is adapted to be assembled by sliding or translating said plurality of first electrodes or first substrates along said core member and then rotating at least some of said first electrodes or first substrates relative to said core member so that at least some of said first electrodes or first substrates are rotated into position on said core member so that the first electrodes or first substrates become axially fixed on said core member.

50. An annular ion guide comprising:

an inner component as claimed in claim 49; and an outer array of electrodes;

wherein said inner component is located within said outer array of electrodes so that an annular ion guiding region is formed, in use, between said inner and outer arrays of electrodes.

* * * * *